US009178300B1

(12) United States Patent
Huang

(10) Patent No.: US 9,178,300 B1
(45) Date of Patent: Nov. 3, 2015

(54) POWER PLUG PROTECTOR ASSEMBLY

(71) Applicant: Albert Huang, Taipei (TW)

(72) Inventor: Albert Huang, Taipei (TW)

( * ) Notice: Subject to any disclaimer, the term of this patent is extended or adjusted under 35 U.S.C. 154(b) by 0 days.

(21) Appl. No.: 14/453,122

(22) Filed: Aug. 6, 2014

(51) Int. Cl.

| | |
|---|---|
| ***H01R 24/30*** | (2011.01) |
| ***H01R 13/502*** | (2006.01) |
| ***H01R 13/652*** | (2006.01) |
| ***H01R 13/713*** | (2006.01) |
| ***H01R 13/52*** | (2006.01) |

(52) U.S. Cl.
CPC ..... *H01R 13/502* (2013.01); *H01R 13/5202* (2013.01); *H01R 13/652* (2013.01); *H01R 13/7137* (2013.01)

(58) Field of Classification Search
CPC ..... H01R 24/30
USPC ..... 439/620.3, 106
See application file for complete search history.

(56) References Cited

U.S. PATENT DOCUMENTS

| | | | | |
|---|---|---|---|---|
| 4,679,884 | A * | 7/1987 | Klemp | 439/620.3 |
| 5,315,476 | A * | 5/1994 | Hedrick | 439/620.3 |
| 7,140,920 | B1 * | 11/2006 | Lin | 439/620.3 |
| 2011/0117782 | A1 * | 5/2011 | Su | 439/620.3 |

* cited by examiner

*Primary Examiner* — Tho D Ta
(74) *Attorney, Agent, or Firm* — Birch, Stewart, Kolasch & Birch, LLP

(57) ABSTRACT

A power plug assembly has: a protective casing having a cavity defined in the protective casing; a positive electrode prong terminal mounted in the cavity of the protective casing and extending out of the protective casing; a protecting assembly mounted in the cavity and having a bimetal contacting plate mounted in the protective casing and having a fixing end mounted securely in the cavity; and a free end being opposite to the fixing end and contacting the positive electrode prong terminal, wherein the bimetal contacting plate deforms and bends to make the free end separated from the positive electrode prong terminal when suffering sufficient heat; a negative electrode prong terminal mounted outside the protective casing; and a ground prong terminal mounted outside the protective casing. The negative electrode prong terminal and the ground prong terminal outside the protective casing would not negatively affect the bimetal contacting plate.

10 Claims, 11 Drawing Sheets

POWER PLUG PROTECTOR ASSEMBLY

BACKGROUND OF THE INVENTION

1. Field of the Invention

The present invention relates to a protector assembly, and more particularly to a power plug protector assembly has a prong mounted outside a casing to prevent a bimetal electrical contact in the casing from deforming when the prong terminal is inadvertently bent by excessive external force.

2. Description of Related Art

Power plugs are necessary components for all electronic devices and may be plugged to a power receptacle so that the electronic devices can be supplied with electrical power and operate. A conventional power plug has a casing, a positive electrode prong, a negative electrode prong, a grounding prong and a protecting assembly. The prongs are mounted partially the casing and partially extend out of the casing. The protecting assembly has a bimetal electrical contact having two ends. One end of the bimetal electrical contact is mounted in the casing and the other end contacts the positive electrode prong. The bimetal electrical contact is capable of bending and separating from the positive electrode prong when heated to make a break circuit such that excessive current would not damage the power plug and the electronic devices connected to the power plug. However, all prongs are inserted partially in the casing. If one of the prongs is inadvertently deformed due to improper plugging or unplugging operation, the casing will be pulled and broken and the bimetal electrical contact will inadvertently shift such that over current protection function of the bimetal electrical contact will fail.

To overcome the shortcomings, the present invention provides a power plug protector assembly to mitigate or obviate the aforementioned problems.

SUMMARY OF THE INVENTION

The main objective of the invention is to provide a power plug protector assembly has a prong mounted outside a casing to prevent a bimetal electrical contact in the casing from deforming when the prong terminal is inadvertently bent by excessive external force.

A power plug assembly in accordance with the present invention comprises: a protective casing having a cavity defined in the protective casing; a positive electrode prong terminal mounted in the cavity of the protective casing and extending out of the protective casing; a protecting assembly mounted in the cavity and having a bimetal contacting plate mounted in the protective casing and having a fixing end mounted securely in the cavity; and a free end being opposite to the fixing end and contacting the positive electrode prong terminal, wherein the bimetal contacting plate deforms and bends to make the free end separated from the positive electrode prong terminal when suffering sufficient heat; a negative electrode prong terminal mounted outside the protective casing; and a ground prong terminal mounted outside the protective casing. The negative electrode prong terminal and the ground prong terminal outside the protective casing would not negatively affect the bimetal contacting plate.

Other objectives, advantages and novel features of the invention will become more apparent from the following detailed description when taken in conjunction with the accompanying drawings.

BRIEF DESCRIPTION OF THE DRAWINGS

in FIG. 5;

in FIG. 7;

in FIG. 5 connected a cable;

DETAILED DESCRIPTION OF THE PREFERRED EMBODIMENT

Figure 1:
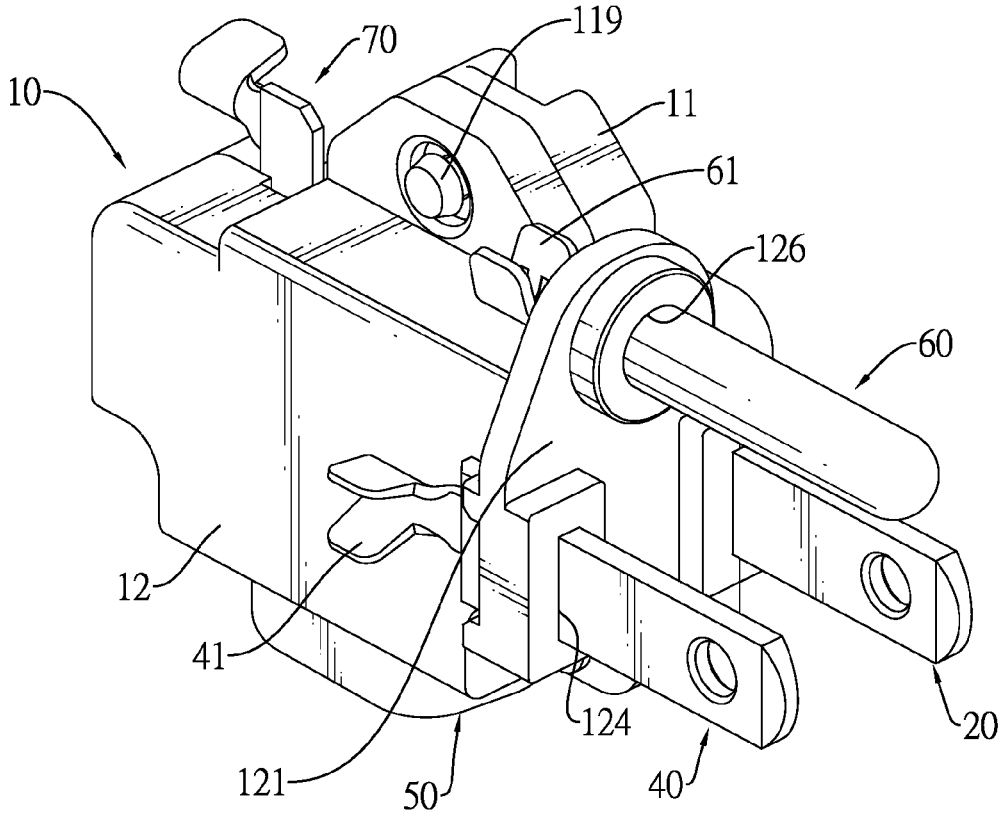
FIG. 1 is a perspective view of a first embodiment of a power plug protector assembly in accordance with the present invention.
Figure 2:
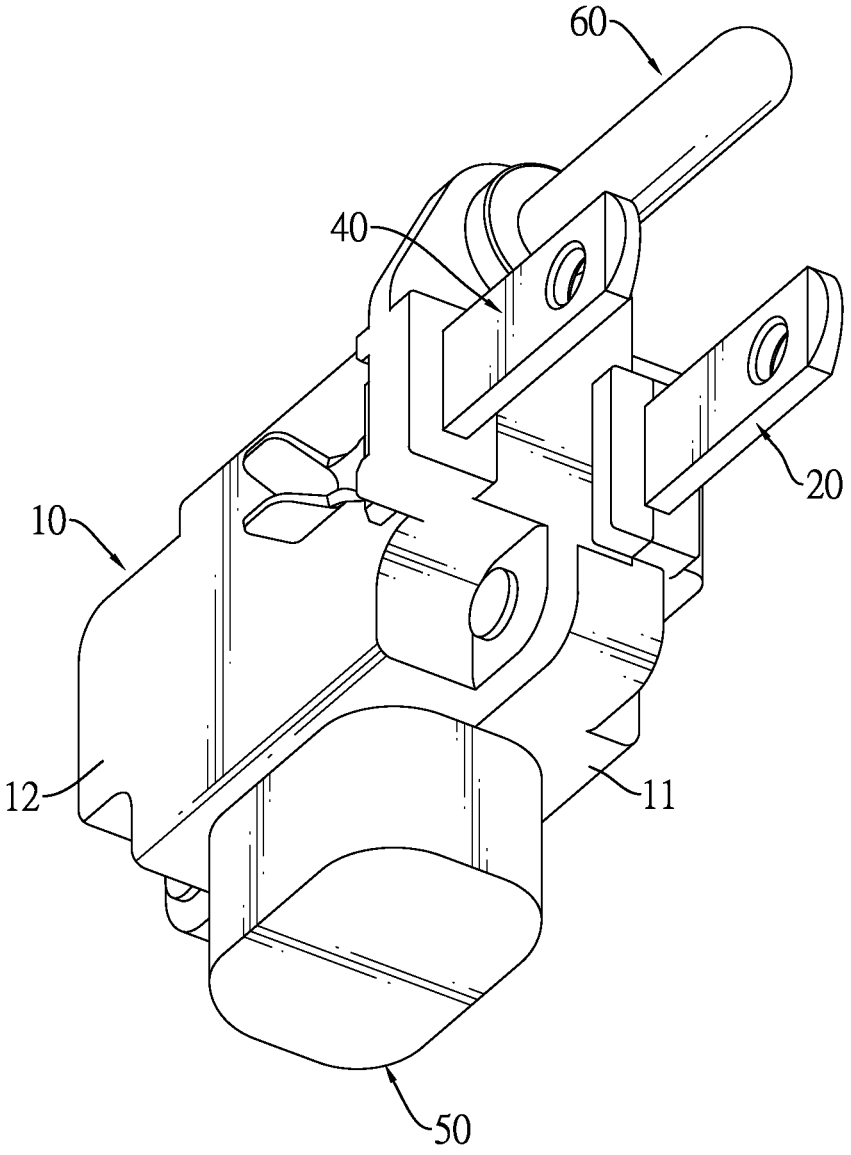
FIG. 2 is another perspective view of the power plug protector assembly in FIG. 1.
Figure 3:
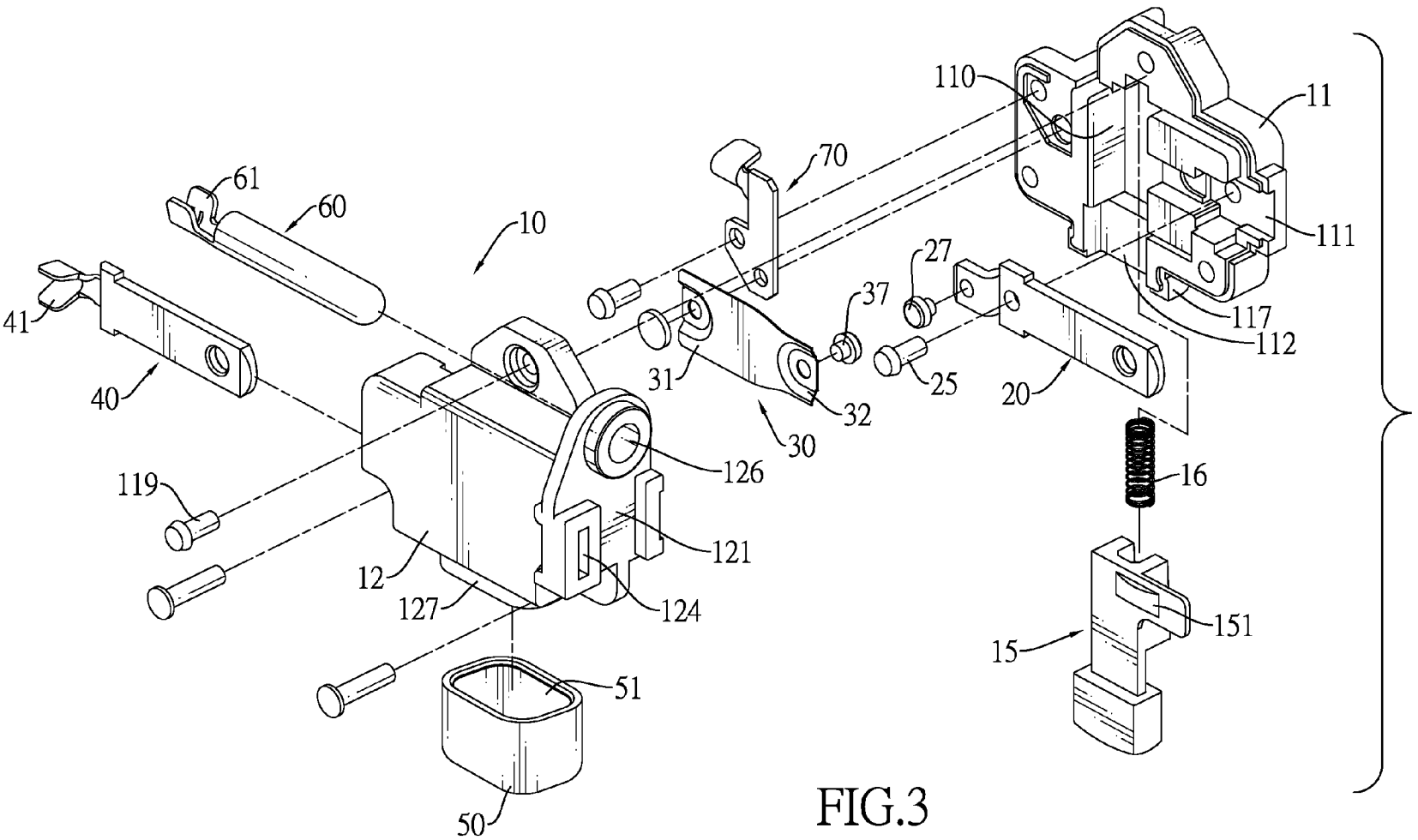
FIG. 3 is an exploded perspective view of the power plug protector assembly in FIG. 1.
Figure 4:
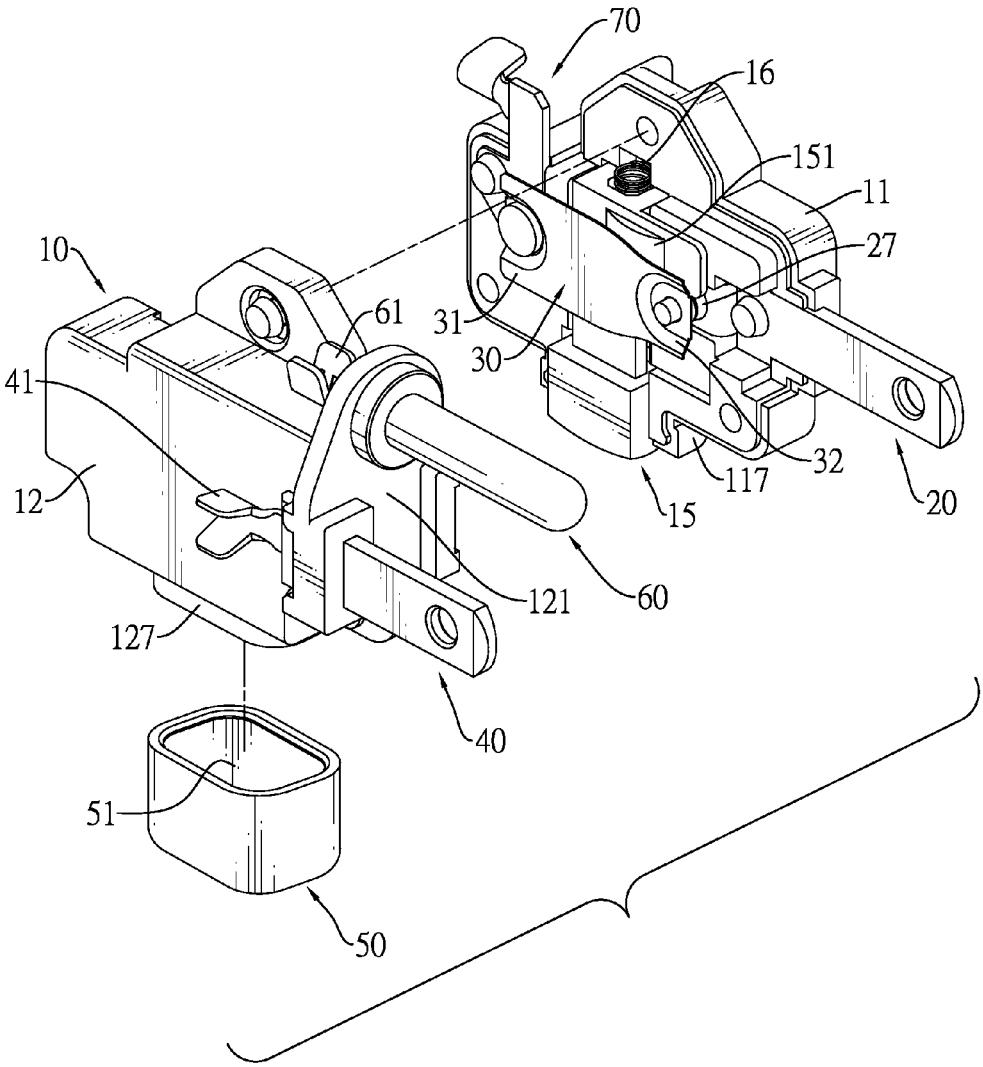
FIG. 4 is a partially exploded perspective view of the power plug protector assembly in FIG. 1.

With reference to FIGS. 1 and 2, a first embodiment of a power plug protector assembly in accordance with the present invention is tri-prong type and comprises a protective casing 10, a positive electrode prong terminal 20, a protecting assembly, a negative electrode prong terminal 40, a ground prong terminal 60 and a waterproof cap 50.

The protective casing 10 may be made of thermosetting resin and has a body 11 and a cover 12.

The body 11 has a cavity 110, a first through hole 111, a second through hole 112 and a first mounting protrusion 117. The cavity 110 is defined in the body 11. The first through hole 111 is defined through the body 11 and communicates with the cavity 110. The second through hole 112 is defined through the body 11 and communicates with the cavity 110. The first mounting protrusion 117 is formed on and protrudes downward from the body 11.

The cover 12 is mounted on the body 11, may be mounted securely on the body 11 through a fastener 119 such as a rivet, covers the cavity 110 and has a mounting board 121, a first mounting hole 124, a second mounting hole 126 and a second mounting protrusion 127. The mounting board 121 is formed on the cover 12. The first mounting hole 124 is defined through the mounting board 121. The second mounting hole 126 is defined through the mounting board 121. The second mounting protrusion 127 is formed on and protrudes downward from the cover 12 and cooperates with the first mounting protrusion 117 to surround the second through hole 112.

The positive electrode prong terminal 20 is mounted in the cavity 110 of the protective casing 10, extends out through the first through hole 111 of the protective casing 10 and has a first contacting member 27. The first contacting member 27 is mounted on the positive electrode prong terminal 20.

The protecting assembly is mounted in the cavity 110 of the protective casing 10 and has a bimetal contacting plate 30, a circuit recovery button 15, a spring 16 and a wire plate 70.

The bimetal contacting plate 30 is mounted in the protective casing 10 and has a fixing end 31, a free end 32 and a second contacting member 37. The fixing end 31 is mounted securely in the cavity 110 of the body 11. The free end 32 is opposite to the fixing end 31 and contacts the positive electrode prong terminal 20. The bimetal contacting plate 30 deforms and bends to make the free end 32 separated from the positive electrode prong terminal 20 when suffering sufficient heat. The second contacting member 37 is mounted on the free end 32 of the bimetal contacting plate 30. Preferably, the fixing end 31 of the bimetal contacting plate 30 is mounted in the cavity 110 of the protective casing 10 through a fastener 25. The fastener 25 may be a rivet.

The circuit recovery button 15 is mounted slidably in the cavity 110 of the protective casing 10, extends out of the second through hole 112, intersects the bimetal contacting plate 30 and has a stopper 151. The stopper 151 is formed on the circuit recovery button 15.

The spring 16 is mounted between the circuit recovery button 15 and an inner wall of the cavity 110 of the protective casing 10.

Figure 5:
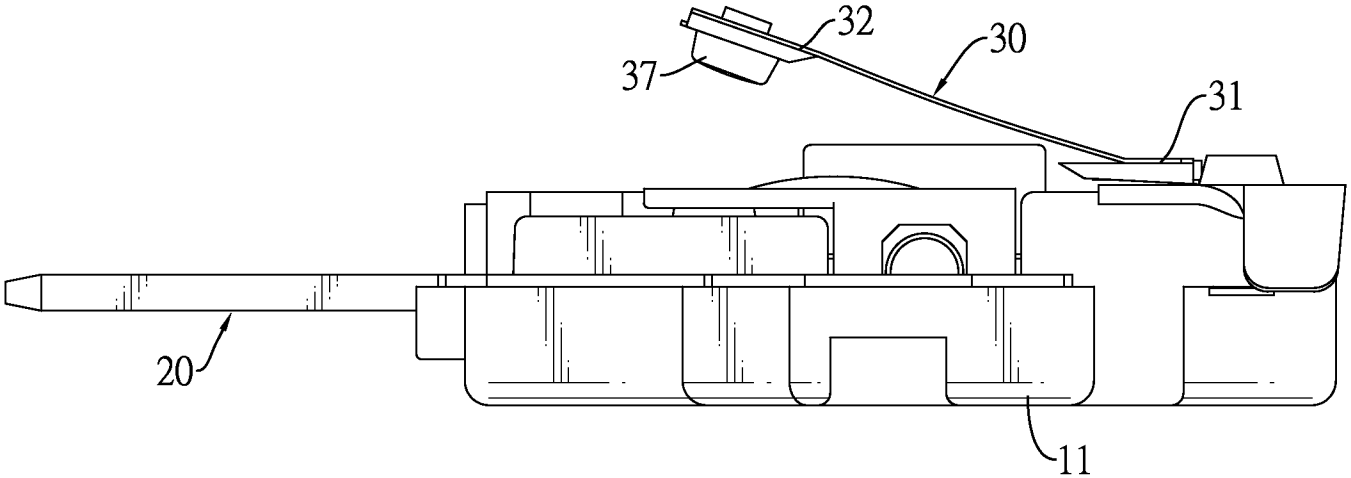
FIG. 5 is a top view of components of the power plug protector assembly in FIG. 1.
Figure 6:
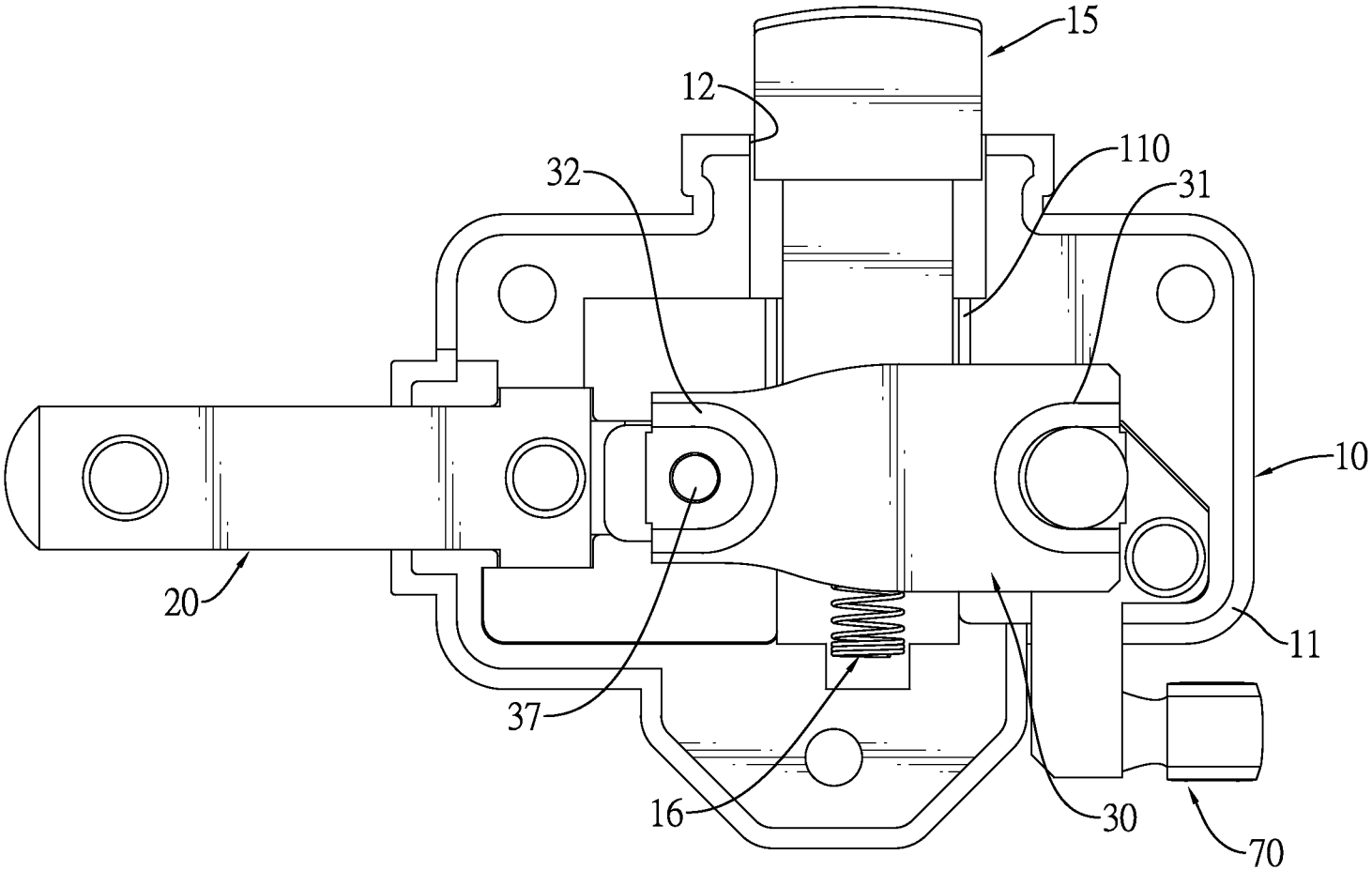
FIG. 6 is a front view of the components of the power plug protector assembly in FIG. 5.
Figure 7:
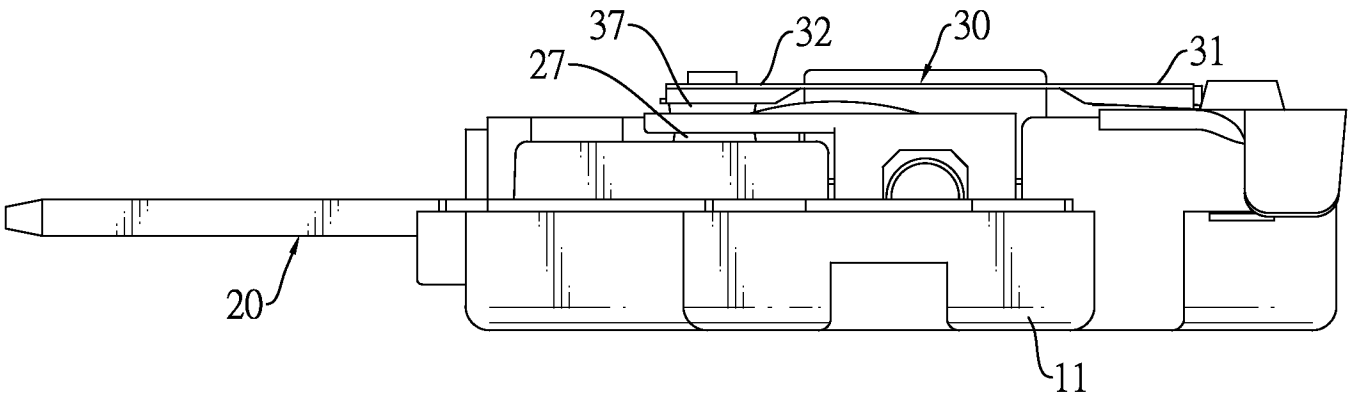
FIG. 7 is an operational top view of the components of the power plug protector assembly in Fig.
Figure 8:
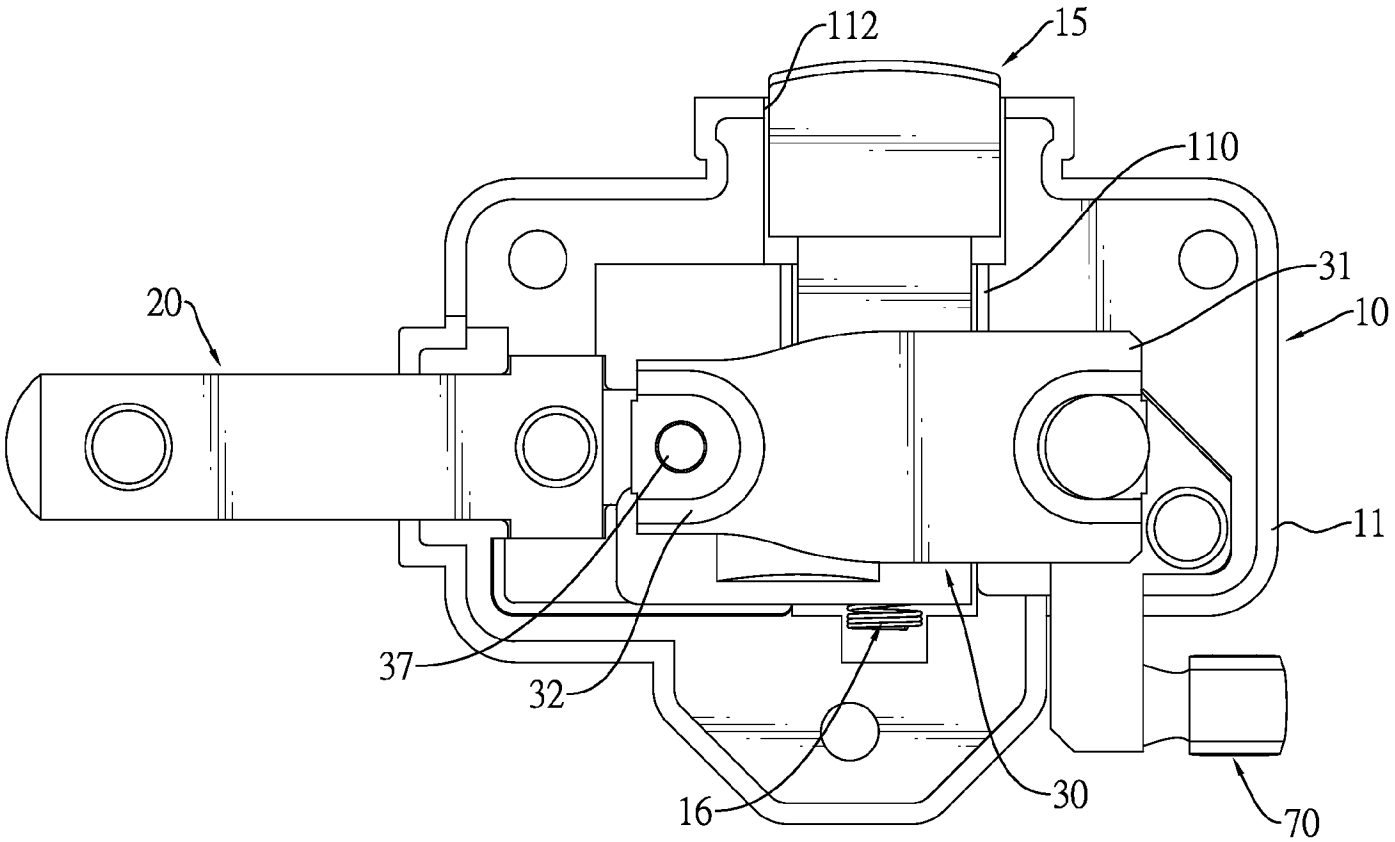
FIG. 8 is an operational front view of the components of the power plug protector assembly in Fig.

With further reference to FIGS. 7 and 8, when the bimetal contacting plate 30 contacts the positive electrode prong terminal 20 and the circuit recovery button 15 is in a deeper position relative to the cavity 110, the stopper 151 is hooked by the bimetal contacting plate 30 and retains in the deeper position. With further reference to FIGS. 5 and 6, when the bimetal contacting plate 30 is heated and bent to make the free end 32 separated from the positive electrode prong terminal 20, the stopper 151 is released by the bimetal contacting plate and the spring 16 forces the circuit recovery button 15 to slide out to a shallower position relative to the cavity 110 of the protective casing 10. When the circuit recover button 15 is located at the shallower position, the stopper 151 pushes and separates the free end 32 of the bimetal contacting plate 30 such that the free end of the bimetal contacting plate 30 is unable to contact the positive electrode prong terminal 20 when the bimetal contacting plate 30 is cooled and recovered without bending. When the circuit recovery button 15 is pushed manually into the deeper position relative to the cavity 110, the stopper 151 is unable to push the bimetal contacting plate 30 such that the bimetal contacting plate 30 is able to contact the positive electrode prong terminal 20 again.

The wire plate 70 is mounted on the protective casing 10, contacts the fixing end 31 of the bimetal contacting plate 30 and partially extends out of the protective casing 10 for connection with an external wire.

The negative electrode prong terminal 40 is mounted outside the protective casing 10, extends securely through the first mounting hole 124 and has a first wire clip 41 formed on the negative electrode prong terminal 40.

The ground prong terminal 60 is mounted outside the protective casing 10, extends securely through the second mounting hole 126 and has a second wire clip 61 formed on the negative electrode prong terminal 40

The waterproof cap 50 may be made of rubber, is mounted hermetically around the first mounting protrusion 117 and the second mounting protrusion 127 and covers the circuit recovery button 15. The waterproof cap 50 has an assembling hole 51 defined in the waterproof cap 50 and mounted around the first mounting protrusion 117 and the second mounting protrusion 127.

Figure 9:
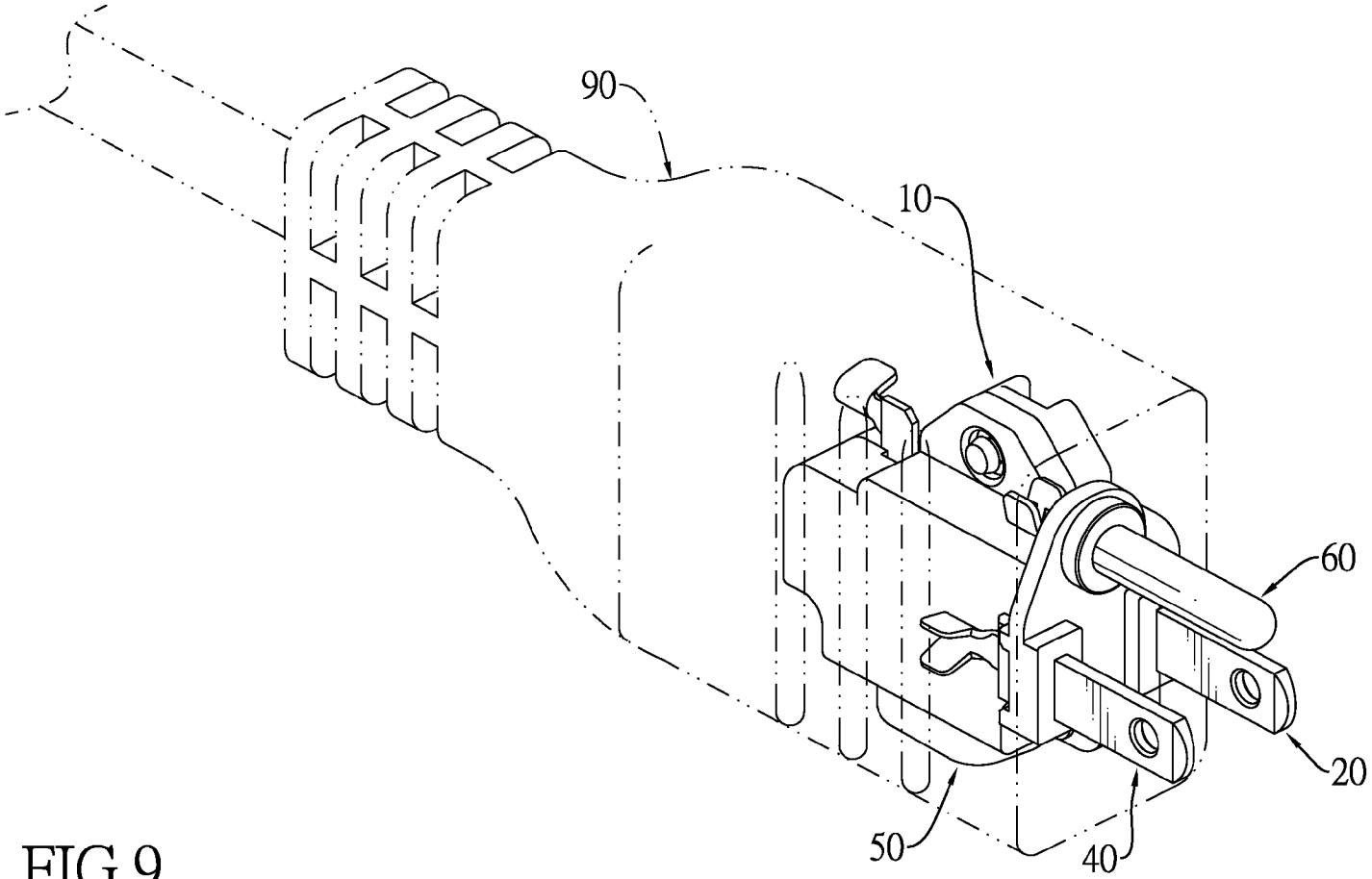
FIG. 9 is a perspective view of the power plug protector assembly in Fig.

With further reference to FIG. 9, a sheath 90 may be made of rubber and covers the protective casing 10 to form the power plug protector assembly in to a power plug. The power plug may be connected to a cable.

Figure 10:
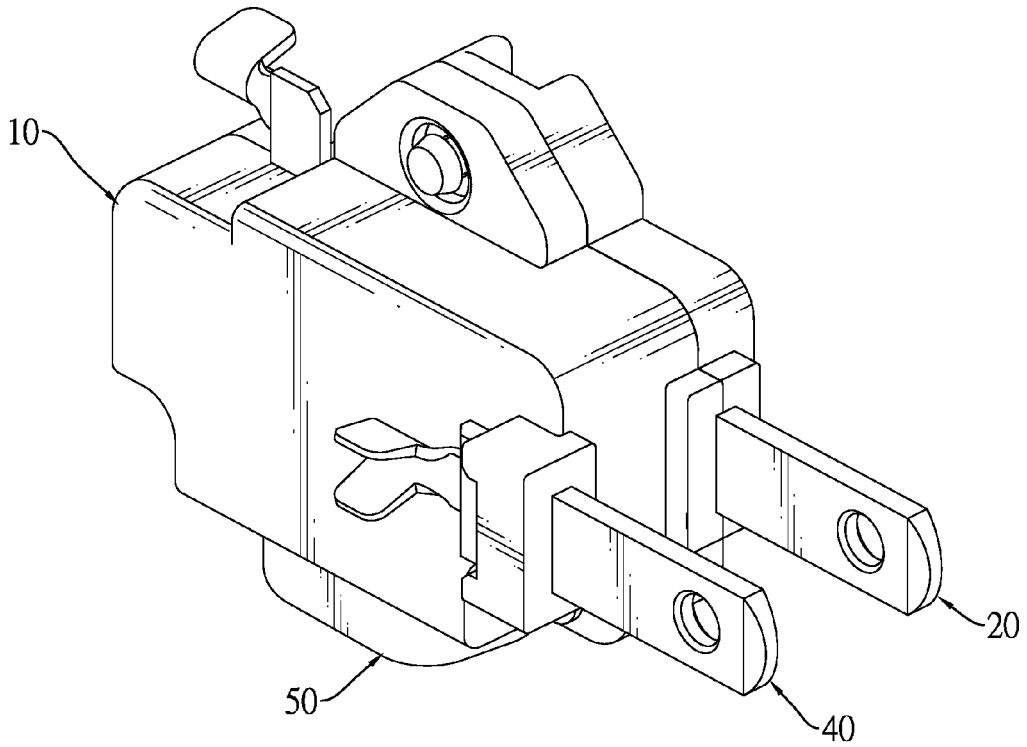
FIG. 10 is a perspective view of a second embodiment of a power plug protector assembly in accordance with the present invention.
Figure 11:
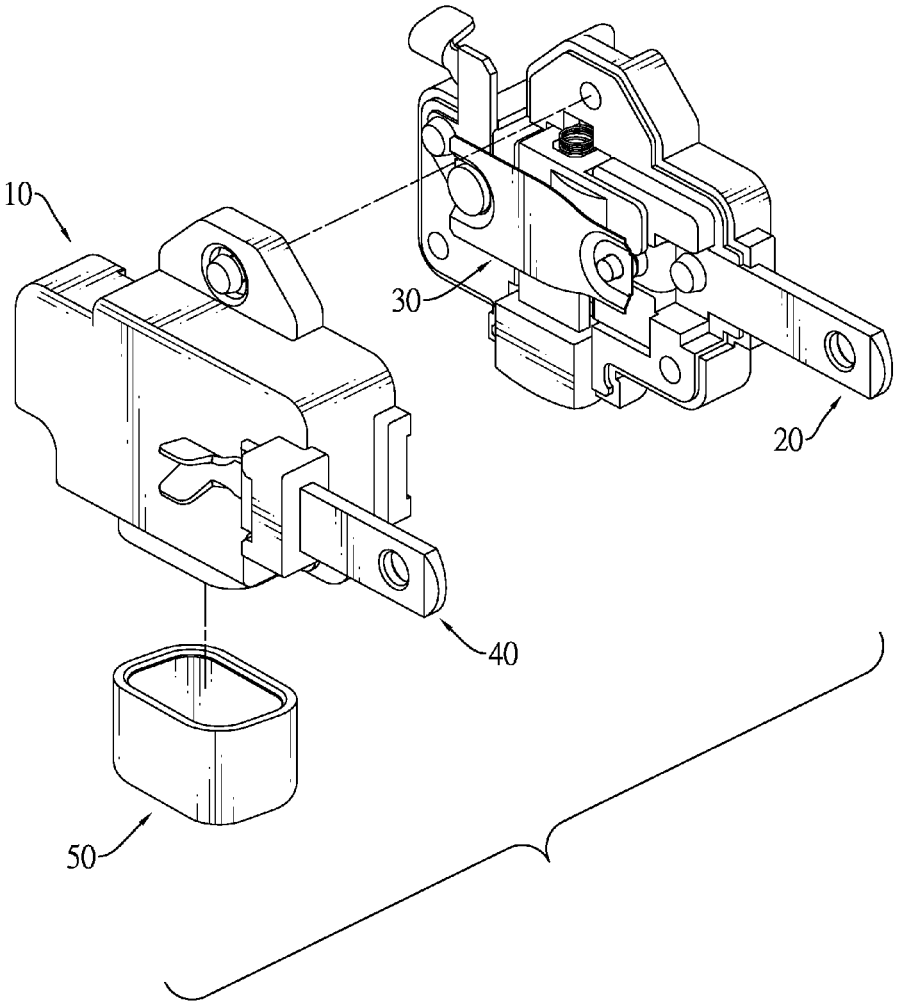
FIG. 11 is a partially exploded perspective view of the power plug protector assembly in FIG. 10.

With further reference to FIGS. 10 and 11, a second embodiment of the power plug protector assembly in accordance with the present invention is similar to the first embodiment, is dual-prong type and omits the ground prong terminal 60.

The power plug protector assembly of the present invention has the following advantages:

1. Only positive electrode prong terminal 20 is mounted in the protective casing 10, and the remaining negative electrode prong terminal 40 and the ground prong terminal 60 are both mounted outside of the protective casing 10. Therefore, after the power plug assembly suffers repeated pulling and plugging operations, inadvertently deformed or displaced negative electrode prong terminal 40 and the ground prong terminal 60 would not negatively affect the bimetal contacting plate 30. Therefore, the bimetal contacting plate 30 still keeps the protective functions and prevents the power plug assembly and an electronic device connected to the power plug assembly from being burned damaged.

2. The exposed part of the wire plate 70, the first wire clip 41 of the negative electrode prong terminal 40 and the second wire clip 61 of the ground prong terminal 60 are located outside the protective casing 10 for connecting wires in a cable. Therefore, the wires of the cable may be attached outside the protective casing 10 instead of being inserted into the protective casing 10, which reduces negative effects to the power plug assembly.

3. The protective casing 10 is made of thermosetting resin that is fireproof and has excellent heat-resistance without deformation under high temperature. Therefore, the protective casing 10 is safe and durable when compared to conventional ones.

4. The waterproof cap 50 may be formed integrally on the protective casing 10 or be mounted on the protective casing 10 by screws to prevent water or electrical conductive liquid from entering the protective casing 10 and incurring safety problems.

5. The positive electrode prong terminal 20 is mounted securely in the protective casing 10 by the fastener 20 such that the internal part of the positive electrode prong terminal 20 would not be easily detached from the protective casing 10 when the external part thereof is inadvertently pressed or pulled by external force.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A power plug assembly comprising:

a protective casing having a cavity defined in the protective casing;

a positive electrode prong terminal mounted in the cavity of the protective casing and extending out of the protective casing;

a protecting assembly mounted in the cavity and having a bimetal contacting plate mounted in the protective casing and having a fixing end mounted securely in the cavity; and a free end being opposite to the fixing end and contacting the positive electrode prong terminal, wherein the bimetal contacting plate deforms and bends to make the free end separated from the positive electrode prong terminal when suffering sufficient heat;

a negative electrode prong terminal mounted outside the protective casing; and a ground prong terminal mounted outside the protective casing, wherein the protective casing has a body, wherein the cavity is defined in the body; and a cover mounted on the body, covering the cavity and having a mounting board formed on the cover; a first mounting hole defined through the mounting board; and a second mounting hole defined through the mounting board; the negative electrode prong terminal extends securely through the first mounting hole; and the ground prong terminal extends securely through the second mounting hole.

2. The power plug assembly as claimed in claim 1, wherein the protective casing is made of thermosetting resin.

3. The power plug assembly as claimed in claim 1, wherein the body has a first through hole defined through the body and communicating with the cavity; and a second through hole defined through the body and communicating with the cavity;

the positive electrode prong terminal extends out through the first hole; the protecting assembly further has a circuit recovery button mounted slidably in the cavity of the protective casing, extending out of the second through hole, intersecting the bimetal contacting plate and having a stopper formed on the circuit recovery button; and a spring mounted between the circuit recovery button and an inner wall of the cavity of the protective casing;

wherein when the bimetal contacting plate contacts the positive electrode prong terminal and the circuit recovery button is in a deeper position relative to the cavity, the stopper is hooked by the bimetal contacting plate and retains in the deeper position; when the bimetal contacting plate is heated and bent to make the free end separated from the positive electrode prong terminal, the stopper is released by the bimetal contacting plate and the spring forces the circuit recovery button to slide out to a shallower position relative to the cavity of the protective casing.

4. The power plug assembly as claimed in claim 3, wherein a first mounting protrusion is formed on and protrudes downward from the body;

a second mounting protrusion is formed on and protrudes downward from the cover and cooperates with the first mounting protrusion to surround the second through hole; and a waterproof cap is mounted hermetically around the first mounting protrusion and the second mounting protrusion, covers the circuit recovery button and has an assembling hole defined in the waterproof cap and mounted around the first mounting protrusion and the second mounting protrusion.

5. The power plug assembly as claimed in claim 4, wherein a wire plate is mounted on the protective casing, contacts the fixing end of the bimetal contacting plate and partially extends out of the protective casing.

6. The power plug assembly as claimed in claim 5, wherein a first contacting member is mounted on the positive electrode prong terminal; and a second contacting member is mounted on the free end of the bimetal contacting plate.

7. The power plug assembly as claimed in claim 6, wherein the fixing end of the bimetal contacting plate is mounted in the cavity of the protective casing through a fastener.

8. The power plug assembly as claimed in claim 7, wherein the cover is mounted securely on the body through a fastener.

9. The power plug assembly as claimed in claim 8, wherein a first wire clip is formed on the negative electrode prong terminal; and a second wire clip is formed on the negative electrode prong terminal.

10. The power plug assembly as claimed in claim 9, wherein the protective casing is made of thermosetting resin.

* * * * *